United States Patent [19]

Levanto

[11] Patent Number: 5,016,002

[45] Date of Patent: May 14, 1991

[54] MATRIX DISPLAY

[75] Inventor: Lauri Levanto, Salo, Finland

[73] Assignee: Nokia-Mobira OY, Salo, Finland

[21] Appl. No.: 333,986

[22] Filed: Apr. 5, 1989

[30] Foreign Application Priority Data

Apr. 15, 1988 [FI] Finland ..... 881787

[51] Int. Cl.[5] ..... G09F 9/00

[52] U.S. Cl. ..... 340/756; 40/447; 340/752

[58] Field of Search ..... 340/756, 752, 757, 758, 340/759, 760, 761, 762, 763, 764, 765; 313/513, 514–522, 510, 500; 40/450, 451, 452, 550, 551, 552, 447

[56] References Cited

U.S. PATENT DOCUMENTS

| | | | |
|---|---|---|---|
| 2,765,458 | 10/1956 | Hoover | 340/756 |
| 4,611,897 | 9/1986 | Hara et al. | 340/756 |
| 4,794,390 | 12/1988 | Lippman | 340/756 |

*Primary Examiner*—Alvin Oberley
*Attorney, Agent, or Firm*—Darby & Darby

[57] ABSTRACT

A matrix display for the display of alphanumeric characters one of the elements of the basically 5×3 matrix divided into two parts (P5*a*, P5*b*). The matrix can also be applied to a printer.

10 Claims, 3 Drawing Sheets

MATRIX DISPLAY

TECHNICAL FIELD

The invention relates to a matrix display for the display of alphanumeric characters, the elements of the matrix forming a 5×3 matrix.

BACKGROUND OF THE INVENTION

In electronic apparatus such as telephones, radio telephones, radios, household appliances, meters, watches, etc., there are increasingly used functions the control and output of which require the use of an alphanumeric display as an information transfer channel between the apparatus and the user. The aim is to make the electronic apparatus small-sized and inexpensive. However, high requirements continue to be imposed on the display with respect to its clarity and readability. On the other hand, the same requirements apply to large-sized display devices, the largest being used in bulletin boards and in results or score boards in sports arenas.

A number of different display devices based on different matrix constructions are used in electronics today. For example, three different character types have been used in the radio telephones manufactured by the applicant. The oldest is the 7-segment display by means of which it is possible to form the numerals from linear elements in a familiar manner.

For use alongside the 7-segment display there is the 14-segment display, discussed below in greater detail, by means of which most of the alphabetic characters can be formed satisfactorily. Certain devices have 35-dot matrices by means of which beautiful alphabetic characters can be formed and which allow lower-case letters.

The importance of alphabetic characters has increased rapidly with the introduction of new functions the devices. The 7-segment display uses 8 bits of control, which can be obtained at two background levels. The 14-segment display also requires 4 signals and four background levels. Thus the contrast weakens physically to one-half, although this difference will not be as obvious to the plain eye. A 35-dot matrix requires as many as 7 background, levels and 5 signals. An improved form of character should support optical observation and fully compensate for the weakening of the contrast.

Problems appear in present-day displays when known segment displays and matrix displays are used. In the current era of digital watches, the 7-segment (FIG. 1) is familiar to everybody. Its readability is somewhat limited by the fact that several characters differ from some other character by only one element. The line in the character uses up 24–82 percent of the area of the figure, in which case the difference in comparison with the background remains clear.

In the 14-segment (FIG. 2), another 7 elements have been added inside the 7-segment. The coherence of the figures is broken, since at the corners there are three, and in the center as many as eight elements which control one and the same point. The plain eye will not perceive the figure easily, even if a numeral. The width of the line has to be narrowed at the ends of the lines, whereupon the darkness of the character is only 15–30 percent of the surface area of the figure. The 14-segment alphabetic characters do not have the same familiarity to the public as the numerals of the 7-segment display. The 14-segment is seen by the consumer only on certain self-service scales at markets. In the display on the scales the contrast has been increased by a great difference in brightness. Most of the alphabetic characters are therefore "guessable" in form.

The 7×5 matrix (FIG. 3) forms very beautiful numerals and does only a little violence to the forms of letters. Only the Scandinavian characters, as well as A, V, X and Y, are "difficult". Even in these, the matrix letter is familiar from, for example, results or score boards. The coverage is better than in the 14-segment, 20–80 percent, but the form is solid and clear, and therefore perception is easy, even if the character is physically weaker in a liquid crystal display. The matrix, however, requires larger and more expensive control electronics than do 7-segment and 14-segment displays.

From other contexts there are known matrix displays of other sizes also, for example 3×7, 5×3 and 5×5 matrix displays. Using the 5×3 matrix it is possible to implement, at least in principle, all alphanumeric characters. However, known applications are not capable of representing all letters satisfactorily.

The problems described above also apply to printers.

SUMMARY OF THE INVENTION

In the background of the invention there is the problem of developing a simpler and less costly matrix which has better readability than do known matrix constructions.

The problem is solved with the matrix display according to the invention. The matrix display of the present invention comprises elements forming a 5×3 matrix with one element in the middle of the matrix divided into two parts so that the matrix has 16 pixels. In a preferred embodiment, the pixels may preferably have such a shape that the pixel figure is asymmetrical in relation to the center line of the matrix.

It is advantageous to implement the matrix display according to the invention by using a liquid-crystal, plasma, electroluminescence or corresponding display. The matrix display can also be easily applied to a set of lamps or to a mechanical display.

BRIEF DESCRIPTION OF THE DRAWINGS

The invention is described below in greater detail with the aid of an exemplary embodiment and drawings, in which.

DESCRIPTION OF THE PREFERRED EMBODIMENT

Figure 1:
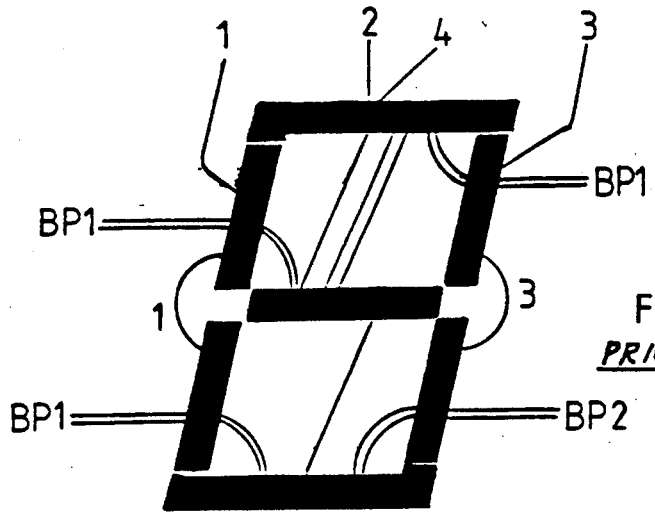
FIG.1 PRIOR ART
FIG. 1 is a schematic representation of the construction of a 7-segment display according to the state of the art.
Figure 2:
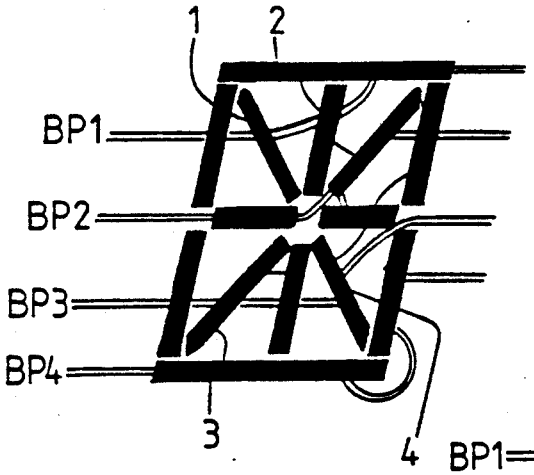
FIG.2 PRIOR ART
FIG. 2 is a schematic representation of the construction of a 14-segment display according to the state of the art.
Figure 3:
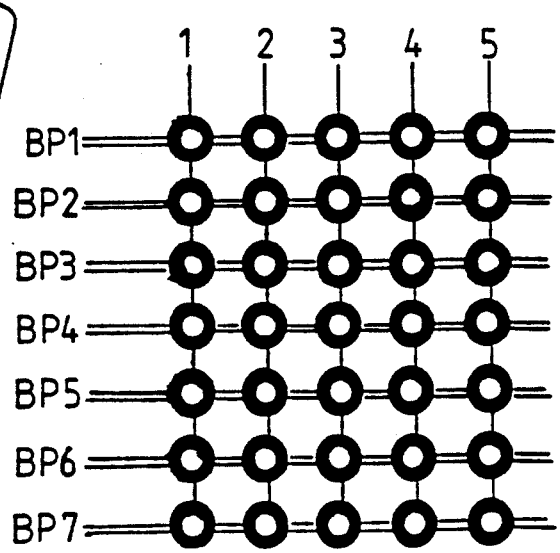
FIG. 3 PRIOR ART
FIG. 3 is a schematic representation of the construction of a 35-dot matrix according to the state of the art.
Figure 4:
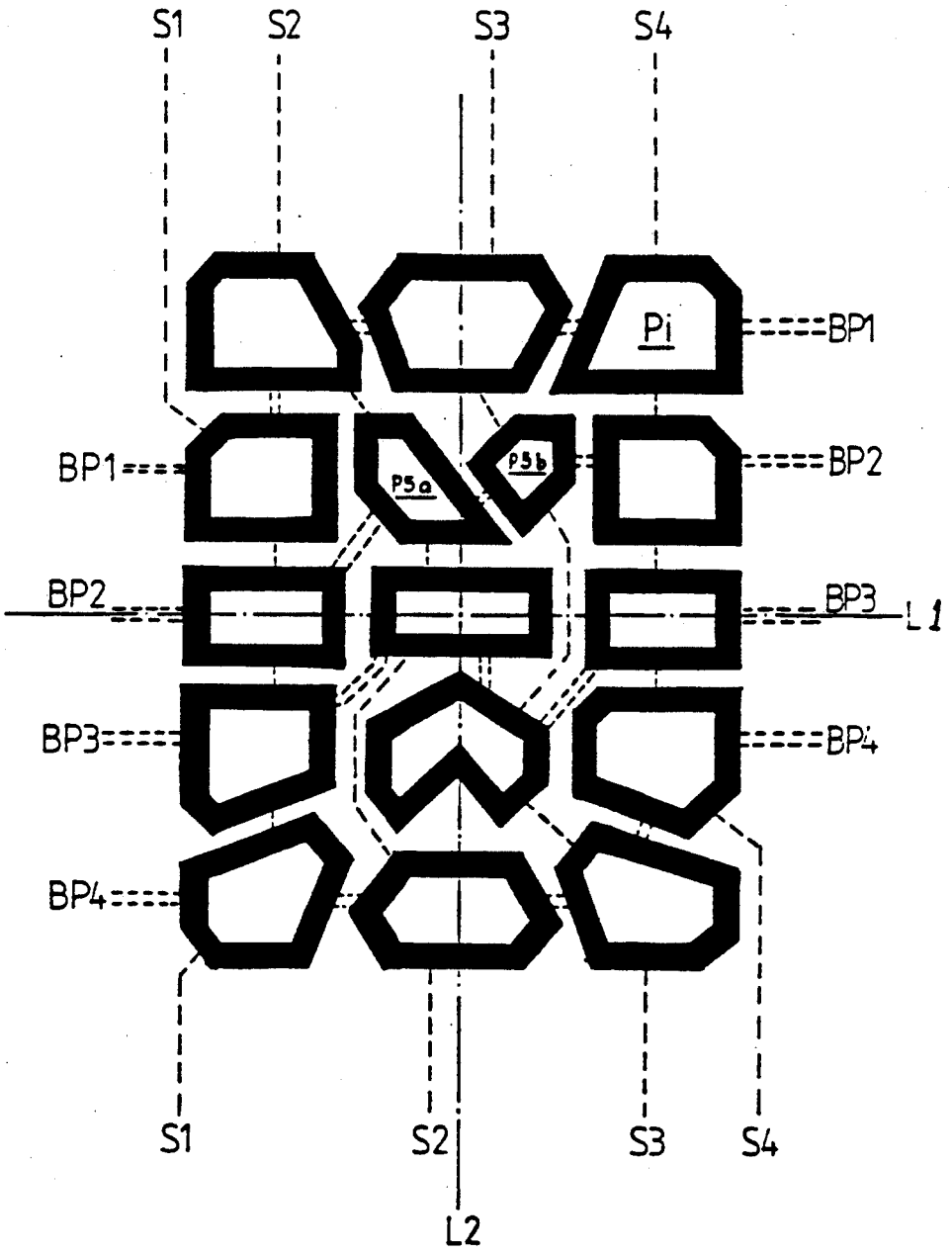
FIG. 4 depicts the construction of a display matrix according to the present invention.

One preferred embodiment of the invention is depicted in FIG. 4, which shows schematically the construction of the matrix. The 16-dot matrix is made up of elements which, for example in a liquid crystal display, are implemented as pixels Pi. The crucial novelty is the unrestricted shape of the pixels, which is possible in, for example, a liquid crystal display. When center lines L1 and L2 are drawn through the matrix, it can be seen that the matrix is asymmetrical in relation to these lines. The display consists of a 3×5 matrix in which the second to highest element P5 in the middle column is divided into parts P5*a*, P5*b* to make a difference between the letters M and N.

The basic forms that are familiar from the 7-segment display have been retained in the numerals. The images of the alphabetic characters have been fitted into this shape, whereby readability is facilitated. The line width is great, whereby a 34–80 percent darkness is obtained. This considerably improves readability in poor light.

The display can be constructed by using 4 signals S1–S4 against 4 background levels BP1–BP4, in which case the same physical control can be used as in the 14-segment display, and even the change in the 14-segment program to drive this new 16-segment display is insignificant.

Figure 5A:
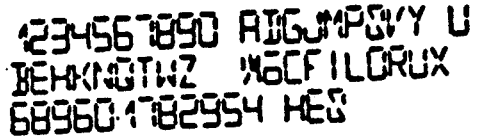
FIG. 5*a–c* is a comparison among the perceived figures produced by different types of display.
Figure 5B:
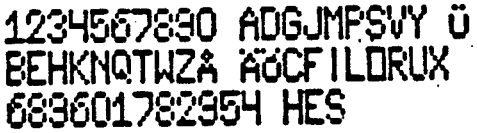
Figure 5C:
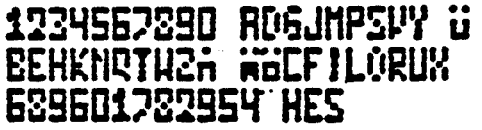

By means of the 16-dot matrix according to FIG. 4, the range of characters depicted in FIG. 5*c* is obtained. FIG. 5 shows, for the sake of comparison, the character ranges of the 14-segment display (FIG. 5*a*) and the 7×5 matrix display (FIG. 5*b*). It can be seen that by using the matrix construction according to the invention the readability of the characters is improved substantially as compared with the 14-segment display, even if it does not reach the quality of the 7×5 matrix.

When it is desired to alter the outer appearance of the characters produced on the display, the pixels may be shaped in different ways. In this case the divided pixel may be located and shaped in different ways.

It is self-evident that the asymmetrical shaping of pixels according to the invention can be applied to both smaller and larger matrices.

A 16-dot matrix can be produced for a plurality of different constructions, such as plasma, electroluminescence and other such displays.

I claim:

1. A matrix display for the display of alphanumeric characters, the elements (Pi) of the matrix forming a 5×3 matrix with outer columns on either side of a center column, characterized in that one element in the middle column of the matrix and within the confines of a perimeter defined by the elements in the outer columns is divided into two parts (P5*a*, (P5*b*) so that the matrix comprises a total of 16 pixels (Pi).

2. A matrix display according to claim 1, characterized in that the divided element (P5) is in the second line of the middle column.

3. A matrix display according to claim 1, characterized in that the pixels of the matrix are shaped so that the pixel figure is asymmetrical in relation to the center lines (L1, L2) of the matrix.

4. A matrix display according to claim 2, characterized in that the pixels of the matrix are shaped so that the pixel figure is asymmetrical in relation to the center line (L1, L2) of the matrix.

5. A matrix display according to any of the above claims 1–3 or 4, characterized in that the pixels are formed on a liquid crystal panel.

6. A matrix according to any of the above claims 1–3 or 4, characterized in that the pixels are formed on a plasma display.

7. A matrix display according to any of the above claims 1–3 or 4, are characterized in that the pixels are formed on an electroluminescence display.

8. A matrix display according to any of the above claims 1–3 or 4, characterized in that the pixels are formed by means of a set of lamps.

9. A matrix display according to any of the above claims 1–3 or 4, characterized in that the pixels are formed by means of mechanical display plates.

10. The matrix display according to claim 3 wherein said divided pixel is generally V-shaped with each element being a leg of the V-shape.

* * * * *